US008148915B2

(12) United States Patent
Chen

(10) Patent No.: US 8,148,915 B2
(45) Date of Patent: Apr. 3, 2012

(54) ELECTRONIC BALLAST DEVICE AND OPERATION METHOD THEREOF

(75) Inventor: Ching-Piao Chen, Zhudong Township, Hsinchu County (TW)

(73) Assignee: Inergy Technology Inc., Jhubei, Hsinchu Country (TW)

( * ) Notice: Subject to any disclaimer, the term of this patent is extended or adjusted under 35 U.S.C. 154(b) by 416 days.

(21) Appl. No.: 12/551,924

(22) Filed: Sep. 1, 2009

(65) Prior Publication Data

US 2011/0050116 A1 Mar. 3, 2011

(51) Int. Cl.
*G05F 1/00* (2006.01)

(52) U.S. Cl. ..... 315/291; 315/194; 315/224; 315/307

(58) Field of Classification Search ..... 315/291, 315/297, 306–310, 246–248, 209 R, 194, 315/127, 224
See application file for complete search history.

(56) References Cited

U.S. PATENT DOCUMENTS

| | | | | |
|---|---|---|---|---|
| 5,118,992 | A * | 6/1992 | Szuba | 315/158 |
| 6,175,195 | B1 * | 1/2001 | Janczak et al. | 315/194 |
| 7,626,344 | B2 * | 12/2009 | Alexandrov | 315/291 |
| 7,863,826 | B2 * | 1/2011 | Kim et al. | 315/224 |

* cited by examiner

*Primary Examiner* — James H Cho
(74) *Attorney, Agent, or Firm* — Muncy, Geissler, Olds & Lowe, PLLC

(57) ABSTRACT

An electronic ballast device includes a stabilizer and a sweep frequency circuit for preheating. The stabilizer includes a first input terminal, a second input terminal and an output terminal connected to a fluorescent lamp. The sweep frequency circuit includes a boost element, an impedance element, a switch and a frequency selective circuit. The boost element includes a first end and a second end separately electrically connected to the first input terminal and the impedance element. The switch includes an input terminal electrically connected to the common contact point of the boost element and the impedance element, an output terminal and a reference voltage input terminal electrically connected to the common contact point of the boost element and the stabilizer. Furthermore, the frequency selective circuit is electrically connected to the output terminal of the switch, the first input terminal of the stabilizer and the second input terminal of the stabilizer.

20 Claims, 3 Drawing Sheets

ELECTRONIC BALLAST DEVICE AND OPERATION METHOD THEREOF

BACKGROUND

1. Field of Invention

The present invention relates to an electronic ballast device. More particularly, the present invention relates to an electronic lamp ballast device.

2. Description of Related Art

Compared with the incandescent light bulb, the advantages of the fluorescent lamp are the higher luminous efficacy, the longer life and the lower heat. Therefore, the fluorescent lamp replaces the incandescent light bulb quickly, and becomes the mainstream.

Generally speaking, the fluorescent lamp has no filament running through it. Instead, cathodes at each end send current through mercury vapors sealed in the tube. Ultraviolet radiation is produced as electrons from the cathodes knock mercury electrons out of their natural orbit. Some of the displaced electrons settle back into orbit, throwing off the excess energy absorbed in the collision. Almost all of this energy is in the form of ultraviolet radiation. To turn this radiation into visible light, the inside of the tube has a phosphor lining. The phosphors have the unique ability to lengthen UV wavelengths to a visible portion of the spectrum. As a result, the phosphors are excited to fluorescence by bursts of UV energy. Fluorescent lamps require a sweep frequency circuit to preheat the lamp, extending the lifetime of the lamp.

Nevertheless, the conventional sweep frequency circuit for preheating is too complex, and the capacitance in the circuit takes too much time to be charged or release the stored charges. Consequently, how to modify and improve the sweep frequency circuit so as to decrease the cost and maintain the preheating function becomes a significant issue.

SUMMARY

Accordingly, one aspect of the invention provides an electronic ballast device, which can reduce the complex and improve the preheating function.

In one embodiment of the invention, an electronic ballast device includes a stabilizer and a sweep frequency circuit for preheating. The stabilizer includes a first input terminal, a second input terminal and an output terminal connected to a fluorescent lamp. The stabilizer further includes a power module used for providing a working voltage to the first input terminal. The sweep frequency circuit for preheating includes a boost element, an impedance element, a switch and a frequency selective circuit. The boost element includes the first end and second end, which are separately electrically connected to the first input terminal and one end of the impedance element. Simultaneously, the other end of the impedance element is connected to the ground. The switch includes an input terminal electrically connected to both the second end of the boost element and the first end of the impedance element, an output terminal and a reference voltage input terminal electrically connected to the first end of the boost element and the first input terminal of the stabilizer. Furthermore, the frequency selective circuit is electrically connected to the output terminal of the switch, the first input terminal of the stabilizer and the second input terminal of the stabilizer.

Consequently, not only can the electronic ballast device be used with fewer electronic elements but also increase the utility and stability.

These and other features, aspects, and advantages of the present invention will become better understood with reference to the following description and appended claims.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
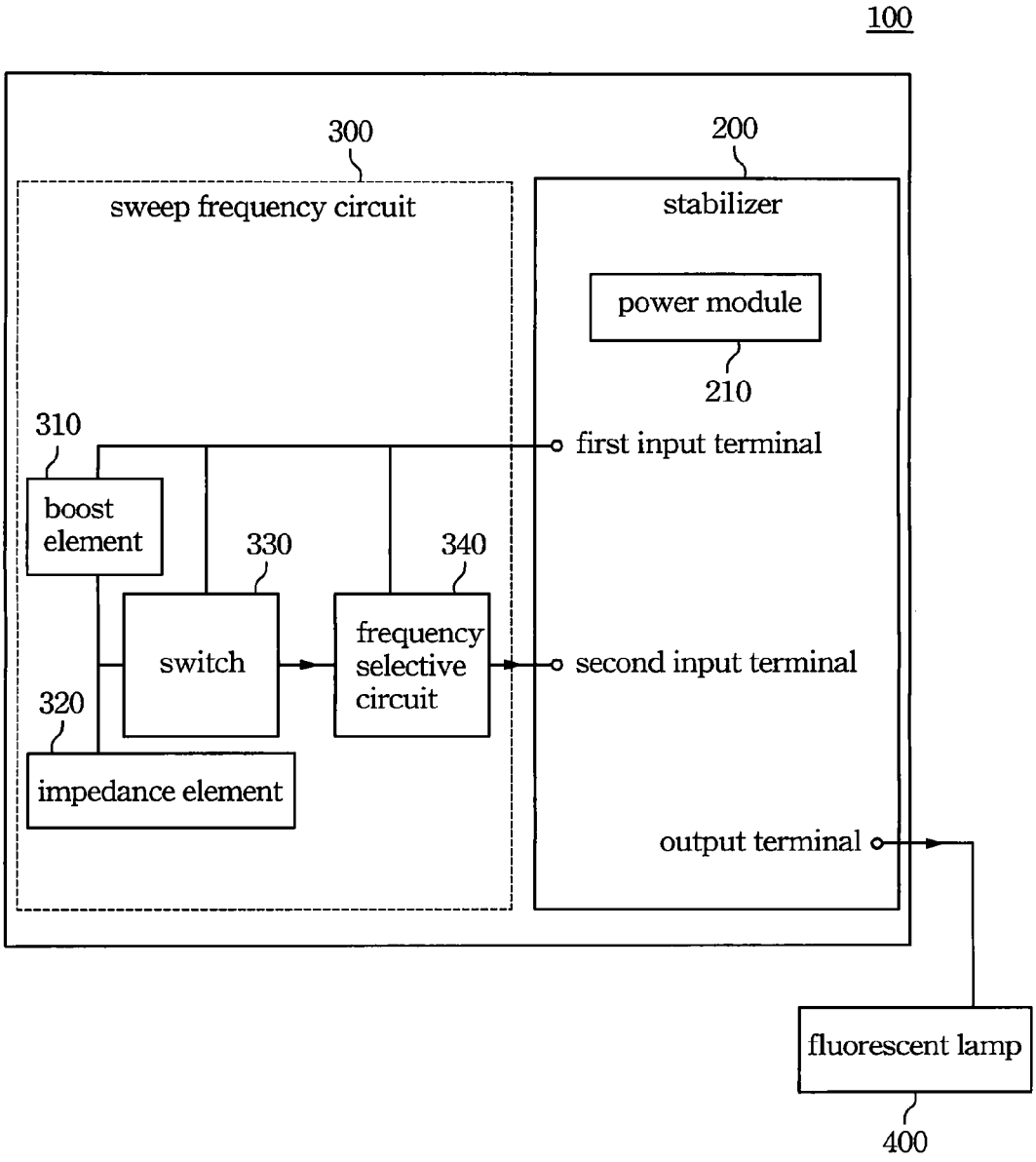
FIG. 1 is a functional block diagram of an electronic lamp ballast device according to an embodiment of the invention.

FIG. 1 is a functional block diagram of an electronic lamp ballast device according to an embodiment of the invention. With reference to FIG. 1, an electronic ballast device 100 includes a stabilizer 200 and a sweep frequency circuit 300 for preheating. The stabilizer 200 includes a first input terminal, a second input terminal and an output terminal connected to a fluorescent lamp 400. The stabilizer 200 further includes a power module 210 used for providing a working voltage to the first input terminal. The sweep frequency circuit 300 for preheating includes a boost element 310, an impedance element 320, a switch 330 and a frequency selective circuit 340. The boost element 310 includes a first end and a second end, which are separately electrically connected to the first input terminal and one end of the impedance element 320. Simultaneously, the other end of the impedance element 320 is connected to ground. The switch 330 includes an input terminal electrically connected to both the boost element 310 and the impedance element 320, an output terminal electrically connected to the frequency selective circuit 340 and a voltage reference input terminal simultaneously electrically connected to the first end of the boost element 310 and the first end of the stabilizer 200. Furthermore, the frequency selective circuit 340 is electrically connected to the first input terminal and the second input terminal of the stabilizer 200.

Figure 2A:
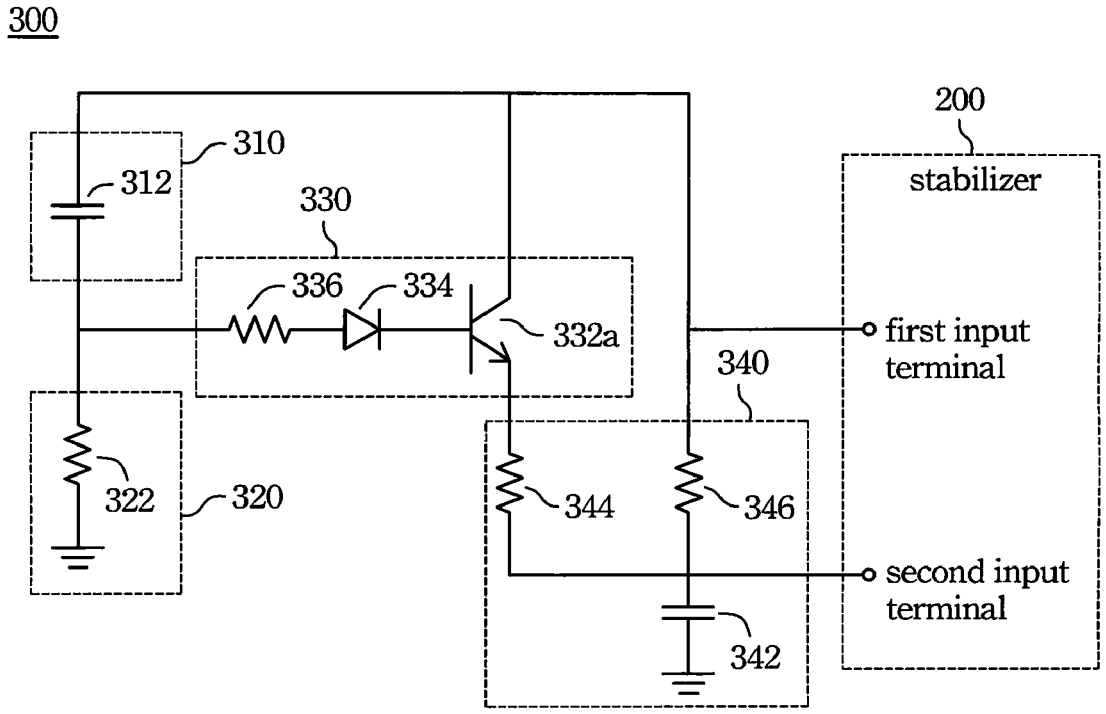
FIG. 2A is a flow chart illustrating a circuit diagram for the frequency selective circuit according to an embodiment of the invention.

FIG. 2A is a flow chart illustrating a circuit diagram for the frequency selective circuit according to an embodiment of the invention. With reference to FIG. 2A, the boost element 310 at least includes a capacitance 312 and the impedance element 320 at least includes a resistance. The switch 330 includes a NPN bipolar junction transistor (BJT) 332*a*, a diode 334 and a base resistor 336. The NPN BJT 332*a* includes a base, a collector and an emitter. The diode 334 includes a P terminal and an N terminal electrically connected to the base of the NPN BJT 332*a*. The base resistor 336 includes a first end electrically connected to the P terminal of the diode 334 and a second end electrically connected to the first end of the impedance element 312 and the second end of the boost element 322.

The frequency selective circuit 340 includes a capacitance 342, a first resistance 344 and a second resistance 346. The capacitance 342 includes a first end and a second end. The first resistance 344 also includes a first end electrically connected to the first end of the capacitance 342 and a second end electrically connected to the emitter of the NPN BJT 332*a*. The second end of the capacitance 342 is electrically connected to the ground. In addition, the second resistance 346 includes a first end electrically connected to a collector of the NPN BJT 332*a* and the first input terminal of the stabilizer 200 and a second end electrically connected to the first end of the capacitance 342 and the second input terminal of the stabilizer 200.

Specifically, when the power module 210 is activated, there will be a working voltage provided to the first input terminal in order to charge the capacitance 312. Then, the capacitance 312 generates a coupling voltage as an input voltage for the switch 330 so that the diode 334 may be forward biased to switch on the NPN BJT 332*a*. The frequency selective circuit 340 also provides a first oscillating frequency to the stabilizer 200, wherein the equivalent resistance of the frequency selective circuit 340 is the first resistance connected in parallel with the second resistance 360 so that the value of the equivalent resistance becomes smaller, and the equivalent capacitance of the frequency selective circuit 340 is the capacitance 342. As the first oscillating frequency is the inverse product of the equivalent resistance and the equivalent capacitance, therefore, the oscillating frequency will rise to be in the range from 90 KHz to 110 KHz for preheating. Furthermore, the base resistance 334 is used for transforming the input voltage into the current, which makes the working state of the NPN BJT much steadier.

When the capacitance 312 is charged to a steady voltage, which is meant that the electronic ballast device 100 has completed the preheating, the capacitance is in the open state and there is an oscillating voltage generated at the input terminal of the switch 330 as well. However, the diode 334 can prevent the oscillating voltage so as to make sure that the NPN BJT 332*a* is in the closed state. At the same time, the frequency selective circuit 340 provides a second oscillating frequency to the stabilizer 200, wherein the equivalent resistance and the equivalent capacitance of the frequency selective circuit 340 are separately the second resistance 346 and the capacitance 342. As the first oscillating frequency is the inverse product of the equivalent resistance and the equivalent capacitance, therefore, the oscillating frequency will decrease to be in the range from 45 KHz to 50 KHz, and further more the time for preheating is determined based on the resistance 322 and the capacitance 312.

In addition, since the capacitance is electrically connected to the first input terminal of the stabilizer 200, the voltage level of the first input terminal will be at zero volts. As the other end of the resistance 322 is electrically connected to the ground, the capacitance 312 can be regarded as being short-circuited so that the capacitance 312 may release the stored charges quickly. As a result, the capacitance 312 can be charged or release the charges quickly so as to maintain the preheating function, when the preheating time is too short, or the fluorescent lamp 400 is switched on and off continuously.

Figure 2B:
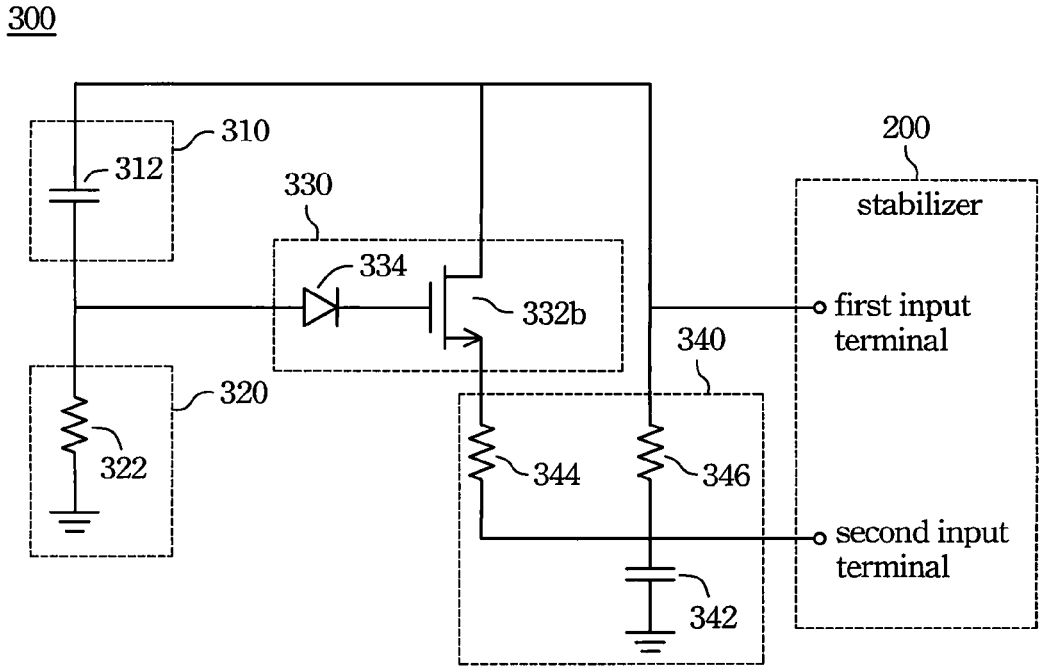
FIG. 2B is a flow chart illustrating a circuit diagram for the frequency selective circuit according to another embodiment of the invention.

FIG. 2B is a flow chart illustrating a circuit diagram for the frequency selective circuit according to another embodiment of the invention. With reference to FIG. 2B, the boost element 310 at least includes a capacitance 312 and the impedance element 320 at least includes a resistance 322. The switch 330 includes a NMOS transistor 332*b* and a diode 334. The NMOS transistor 332*b* includes a gate, a drain and a source. The diode 334 includes a P terminal electrically connected to the common contact point of the impedance element 320 and the boost element 310 and an N terminal electrically connected to the gate of the NMOS transistor 332*b*.

The frequency selective circuit 340 includes a capacitance 342, a first resistance 344 and a second resistance 346. The capacitance 342 including a first end and a second end electrically connected to the ground. The first resistance 344 also includes a first 1o end and a second end, which are separately electrically connected to the first end of the capacitance 342 and the source of the NMOS transistor 332*b*. In addition, the second resistance 346 includes a first end electrically connected to the drain of the NMOS transistor 332*b* and the first input terminal of the stabilizer 200 and a second end electrically connected to the first end of the capacitance 342 and the second input terminal of the stabilizer 200.

Specifically, when the power module 210 is activated, there will be a working voltage provided to the first input terminal in order to charge the capacitance 312. Then, the capacitance 312 generates a coupling voltage as an input voltage for the switch 330 so that the diode 334 may be forward biased to switch on the NMOS transistor 332*b*. The frequency selective circuit 340 also provides a first oscillating frequency to the stabilizer 200, wherein the equivalent resistance of the frequency selective circuit 340 is the first resistance 344 connected in parallel with the second resistance 346 so that the value of the equivalent resistance becomes smaller, and the equivalent capacitance of the frequency selective circuit 340 is the capacitance 342. As a result, the oscillating frequency will rise to be in the range from 90 KHz to 110 KHz for preheating.

When the capacitance 312 is charged to a steady voltage, which indicates that the electronic ballast device 100 has completed the preheating, the capacitance is in the open state and there is an oscillating voltage generated at the input terminal of the switch 330 as well. However, the diode 334 can prevent the oscillating voltage so as to make sure that the NMOS transistor 332*b* is in the closed state. At the same time, the frequency selective circuit 340 provides a second oscillating frequency to the stabilizer 200, wherein the equivalent resistance and the equivalent capacitance of the frequency selective circuit 340 are separately the second resistance 346 and the capacitance 342. Therefore, the oscillating frequency will decrease to be in the range from 45 KHz to 50 KHz, and furthermore the time for preheating is determined based on the resistance 322 and the capacitance 312.

In addition, since the capacitance is electrically connected to the first input terminal of the stabilizer 200, the voltage level of the first input terminal will be at zero volts. As the other end of the resistance 322 is electrically connected to the ground, the capacitance 312 can be regarded as being short-circuited so that the capacitance 312 may release the stored charges quickly. As a result, the capacitance 312 can be charged or release the charges quickly so as to maintain the preheating function, when the preheating time is too short, or the fluorescent lamp 400 is switched on and off continuously.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An electronic ballast device comprising:

a stabilizer comprising:

a first input terminal and a second input terminal;

an output terminal electrically connected to a fluorescent lamp; and a power module for providing a working voltage to the first input terminal; and a sweep frequency circuit comprising:

a boost element comprising a first end electrically connected to the first input terminal and a second end;

an impedance element comprising a first end electrically connected to the second end of the boost element and a second end;

a switch comprising an input terminal electrically connected to the second end of the boost element and the first end of the impedance element, an output terminal and a reference voltage input terminal electrically connected to the first end of the boost element and the first input terminal of the stabilizer; and a frequency selective circuit electrically connected to the output terminal of the switch, the first input terminal of the stabilizer and the second input terminal of the stabilizer.

2. The electronic ballast device of claim 1, wherein the switch further comprises:

a NPN BJT comprising a base, a collector and an emitter;

a diode comprising a P terminal and an N terminal electrically connected to the base of the NPN BJT; and a base resistor comprising a first end electrically connected to the P terminal of the diode and a second end electrically connected to the first end of the impedance element and the second end of the boost element.

3. The electronic ballast device of claim 2, wherein the frequency selective circuit comprises:

a capacitance comprising a first end and a second end;

a first resistance comprising a first end electrically connected to the first end of the capacitance and a second end electrically connected to the emitter of the NPN BJT; and a second resistance comprising a first end electrically connected to the collector of the NPN BJT and the first input terminal of the stabilizer and a second end electrically connected to the first end of the capacitance and the second input terminal of the stabilizer.

4. The electronic ballast device of claim 1, wherein the switch comprises:

a NMOS transistor comprising a gate, a drain and a source; and a diode comprising a P terminal electrically connected to the first end of the impedance element and the second end of the boost element and an N terminal electrically connected to the gate of the NMOS transistor.

5. The electronic ballast device of claim 4, wherein the frequency selective circuit comprises:

a capacitance comprising a first end and a second end;

a first resistance comprising a first end electrically connected to the first end of the capacitance and a second end electrically connected to the source of the NMOS transistor; and a second resistance comprising a first end electrically connected to the drain of the NMOS transistor and a second end electrically connected to the first end of the capacitance and the second input terminal of the stabilizer.

6. The electronic ballast device of claim 1, wherein the boost element comprises a capacitance.

7. The electronic ballast device of claim 1, wherein the impedance element comprises a resistance.

8. An operation method for an electronic ballast device, the method comprising:

providing a stabilizer comprising a first input terminal, a second input terminal and an output terminal electrically connected to a fluorescent lamp, wherein the stabilizer further comprises a power module for providing a working voltage to the first input terminal;

providing a boost element comprising a first end electrically connected to the first input terminal of the stabilizer and a second end;

providing an impedance element comprising a first end electrically connected to the second end of the boost element and a second end;

providing a switch comprising an input terminal electrically connected to the second end of the boost element and the first end of the impedance element, an output terminal and a reference voltage input terminal electrically connected to the first end of the boost element and the first input terminal of the stabilizer; and providing a frequency selective circuit electrically connected to the output terminal of the switch, the first input terminal of the stabilizer and the second input terminal of the stabilizer;

wherein the stabilizer charges the first end of the boost element through the first input terminal of the stabilizer, so as to make the second end of the boost element generate a couple voltage to turn on the switch and then the frequency selective circuit provides a first oscillating frequency to the stabilizer, and wherein the frequency selective circuit provides a second oscillating frequency to the stabilizer when the boost element is charged to a steady voltage.

9. The operation method of claim 8, wherein the first oscillating frequency ranges from 90 KHz to 110 KHz.

10. The operation method of claim 8, wherein the second oscillating frequency ranges from 45 KHz to 50 KHz.

11. The operation method of claim 8, wherein the switch further comprises:

a NPN BJT comprising a base, a collector and an emitter;

a diode comprising a P terminal and an N terminal electrically connected to the base of NPN BJT; and a base resistor comprising a first end electrically connected to the P terminal of the diode and a second end electrically connected to the first end of the impedance element and the second end of the boost element.

12. The operation method of claim 11, wherein the frequency selective circuit comprises:

a capacitance comprising a first end and a second end;

a first resistance comprising a first end electrically connected to the first end of the capacitance and a second end electrically connected to the emitter of the NPN BJT; and a second resistance comprising a first end electrically connected to the collector of the NPN BJT and the first input terminal of the stabilizer, and a second end electrically connected to the first end of the capacitance and the second input terminal of the stabilizer.

13. The operation method of claim 12, further comprising:

determining the first oscillating frequency based on the first resistance, the second resistance and the capacitance.

14. The operation method of claim 12, further comprising:

determining the second oscillating frequency based on the second resistance and the capacitance.

15. The operation method of claim 8, wherein the switch further comprises:

a NMOS transistor comprising a gate, a drain and a source; and a diode comprising a P terminal electrically connected to the first end of the impedance element and the second end of the boost element, and an N terminal electrically connected to the gate of the NMOS transistor.

16. The operation method of claim 15, wherein the switch further comprises:

a capacitance comprising a first end and a second end;

a first resistance comprising a first end electrically connected to the first end of the capacitance and a second end electrically connected to the source of the NMOS transistor; and a second resistance comprising a first end electrically connected to the drain of the NMOS transistor and a second end electrically connected to the first end of the capacitance and the second input terminal of the stabilizer.

17. The operation method of claim 16, further comprising:

determining the first oscillating frequency based on the first resistance, the second resistance and the capacitance.

18. The operation method of claim 16, further comprising:

determining the second oscillating frequency based on the second resistance and the capacitance.

19. The operation method of claim 8, wherein the boost element comprises a capacitance.

20. The operation method of claim 8, wherein the impedance element comprises a resistance.

* * * * *